US005950841A

United States Patent [19]

Knox et al.

[11] Patent Number: 5,950,841

[45] Date of Patent: Sep. 14, 1999

[54] SCREEN ASSEMBLY FOR A VIBRATORY SEPARATOR

[75] Inventors: Peter D. Knox, Union; Ari M. Hukki, Edgewood, both of Ky.

[73] Assignee: Emerson Electric Co., St. Louis, Mo.

[21] Appl. No.: 09/120,621

[22] Filed: Jul. 22, 1998

[51] Int. Cl.[6] ..... B07B 1/28

[52] U.S. Cl. ..... 209/315; 209/325; 209/341; 209/401; 209/403; 209/405; 209/408; 209/412

[58] Field of Search ..... 209/401, 403, 209/405, 408, 409, 412, 311, 315, 325, 326, 331, 332, 341

[56] References Cited

U.S. PATENT DOCUMENTS 2,723,032 11/1955 Gisler et al. ..... 209/401
4,498,981 2/1985 Frevert ..... 209/408 X
5,816,413 10/1998 Boccabella et al. ..... 209/403 X
5,819,952 10/1998 Cook et al. ..... 209/401 X
5,851,393 12/1998 Carr et al. ..... 210/489

*Primary Examiner*—David H. Bollinger
*Attorney, Agent, or Firm*—Lyon & Lyon LLP

[57] ABSTRACT

A vibratory screen system including a screen assembly having screen cloth on both the top and the bottom of the frame. The screen cloth on the bottom has openings larger than and up to five times the size of the openings on the upper screen cloth. A pattern of dividers divide the screen into compartments. The screens are bonded to the frame and to the pattern of dividers.

28 Claims, 4 Drawing Sheets

SCREEN ASSEMBLY FOR A VIBRATORY SEPARATOR

BACKGROUND OF THE INVENTION

The field of the present invention is vibratory screen separators and the screen assemblies therefor.

Vibratory screen separators have long been known which include a base, a resiliently mounted housing, a vibratory drive and screen assemblies positioned on the housing. These screen assemblies are typically circular or rectangular and are positioned between an inlet manifold mounted to or above the housing and an outlet manifold from the housing. Material from the inlet manifold passing through the screen is accumulated by the outlet manifold for discharge. Material which is too large to pass through the screen is conveyed to the edge of the screen where it is discharged through a separate outlet.

The screen assemblies associated with such systems typically include tensioned screen cloth extending across and bonded to a rigid frame. Rectangular screen frames often include ribs extending between the sides of the screen frame. The screen cloth is often bonded to these ribs as well.

Screens are known which employ a top screening screen and a bottom coarse support screen. Systems known as self-cleaning screen kits or assemblies incorporate a supporting perforated plate or coarse mesh screen on the underside of the screen assembly. Sliders are positioned within the frame between the screen cloth and the perforated plate or coarse screen. When vibrated, the sliders are supported by the perforated plate or coarse screen but are thrown against the screening cloth to help reduce blinding. Systems have included ribs across the frame to form compartments within which the sliders are confined.

In all such systems, the screen cloth which performs the principal screening is subject to abrasion and vibratory loads. Ultimately such screens fail if not replaced timely. Failure is sufficiently random with such screens that any timely replacement would leave a very large margin before most screens would fail. Consequently, it is very uneconomical to replace screens timely enough to avoid all screen failures.

Screen failure can be detrimental to the screening process because oversized materials are able to pass through the properly sized screening cloth to the outlet manifold. Means for detecting this failure in a timely basis is also quite difficult and requires almost constant surveillance. Automatic sensing systems are yet to be commercially implemented.

SUMMARY OF THE INVENTION

The present invention is directed to a screen assembly for vibratory separators including a top screen for screening which is affixed to a frame. A bottom screen is affixed to the frame on the other side thereof. This bottom screen has openings therethrough which are up to five times the size of the openings in the top screen used for the screening operation.

In a first aspect of the present invention, the size of the screen openings for the bottom screen being up to five times larger than the openings for the top screen, the bottom screen can pass somewhat larger particles than the top screen upon screen failure of the top screen. As oversized particles accumulate on the bottom screen, the screen is blinded and ceases to pass all particles therethrough. Thus, a screen failure of the top screen results in larger particles of a controlled size passing through the screening system for a short time. The screen assembly then ceases to pass or greatly reduce the passage of such controlled larger particles and, instead, is reduced in capacity.

In a second separate aspect of the present invention, a pattern of dividers is arranged between the top screen and the bottom screen to divide the space inwardly of the frame into small compartments. Such compartments localize blinding of the lower screen and increase the speed at which blinding occurs. The remaining undamaged sections of the screen can continue to function normally until such time as the failure in the one compartment is observed or until such time as such an observed failure can be rectified.

In a further separate aspect of the present invention, attendant features are contemplated such as coarse backup support screens, biased placement of the screen cloth on the frame and on the pattern of dividers, specific configurations of the dividers and of the frames and the bonding of the screens to the dividers.

In yet another separate aspect of the present invention, any of the foregoing separate aspects are contemplated to be incorporated together to enhance functioning of the system.

Accordingly, it is an object of the present invention to provide an improved screen assembly and vibratory separate system. Other and further objects and advantages will appear hereinafter.

DETAILED DESCRIPTION OF THE PREFERRED EMBODIMENT

Figure 1:
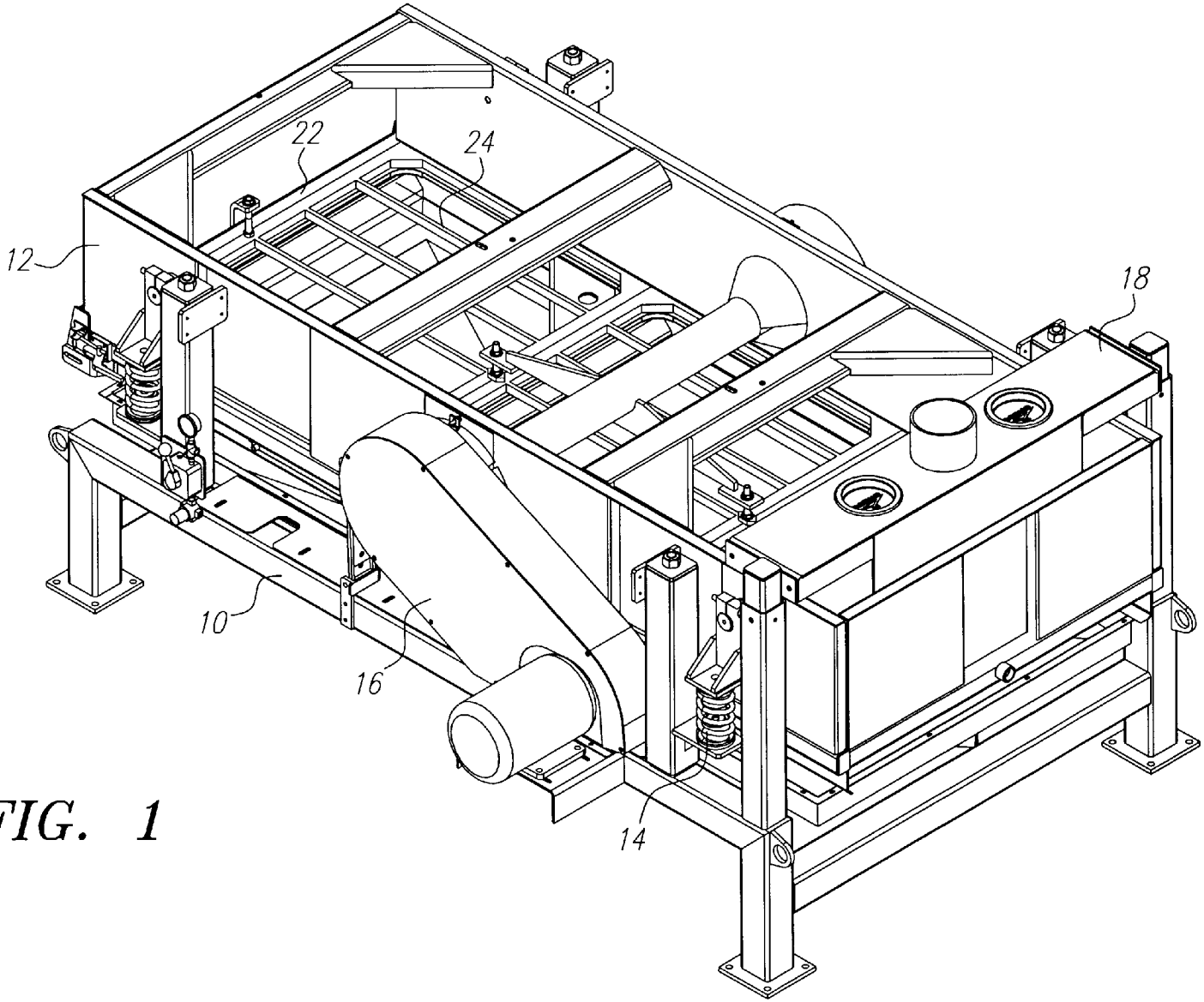
FIG. 1 is a perspective view of a vibratory screen separator.
Figure 2:
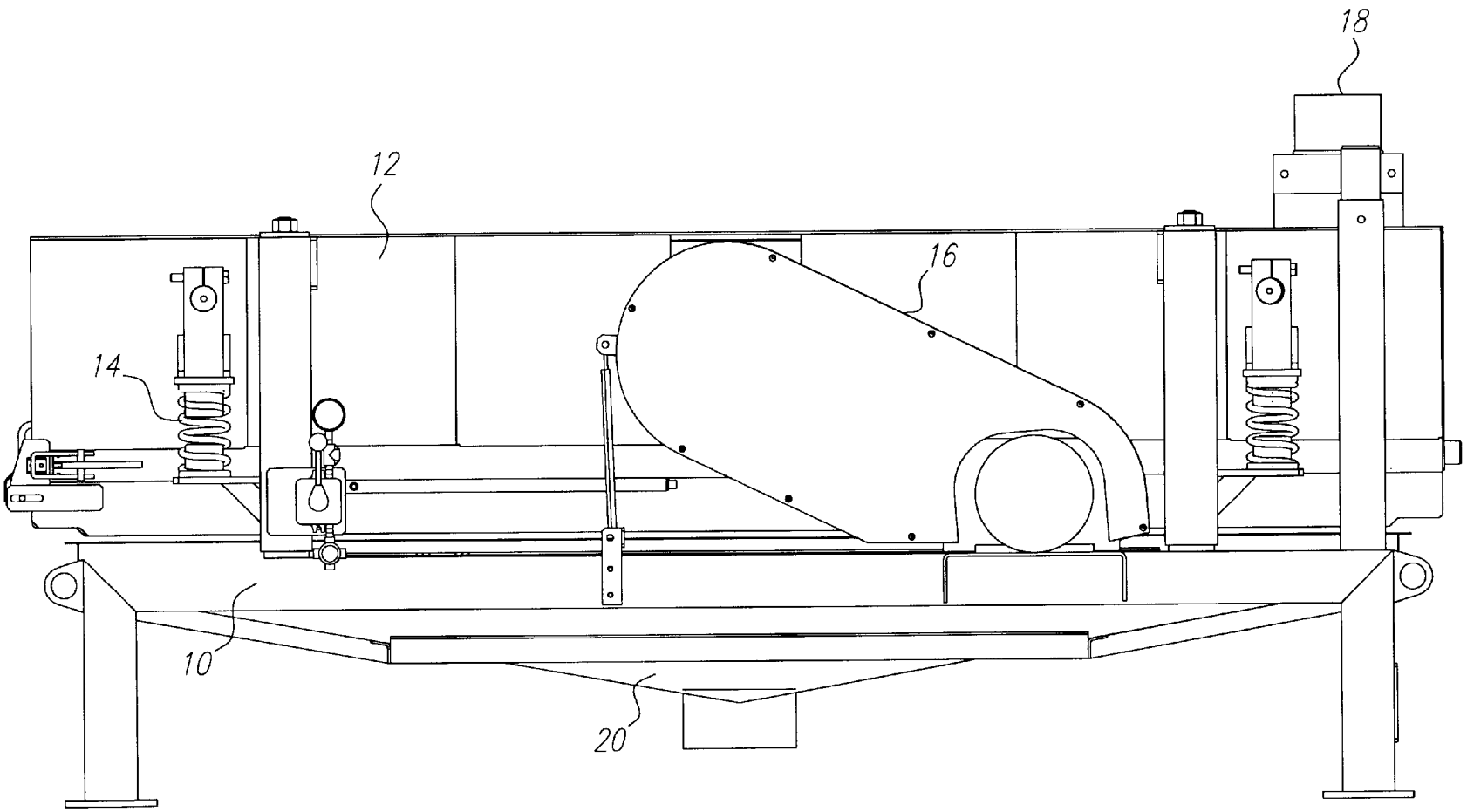
FIG. 2 is a side view of the separator of FIG. 1.

Turning in detail to the drawings, a vibratory screen separator is shown to include a base 10 upon which a housing 12 is resiliently mounted. The resilient mounting of the housing 12 is provided by springs 14. The housing is driven by a vibratory drive such as a motor driven eccentric weight system 16. An input manifold 18 presents material to the separator for screening. An outlet manifold 20 collects the material screened for processing. Oversized material moves from the vibratory separator through a port 22. Screen assemblies 24 are positioned within and sealed to the housing 12.

Figure 3:
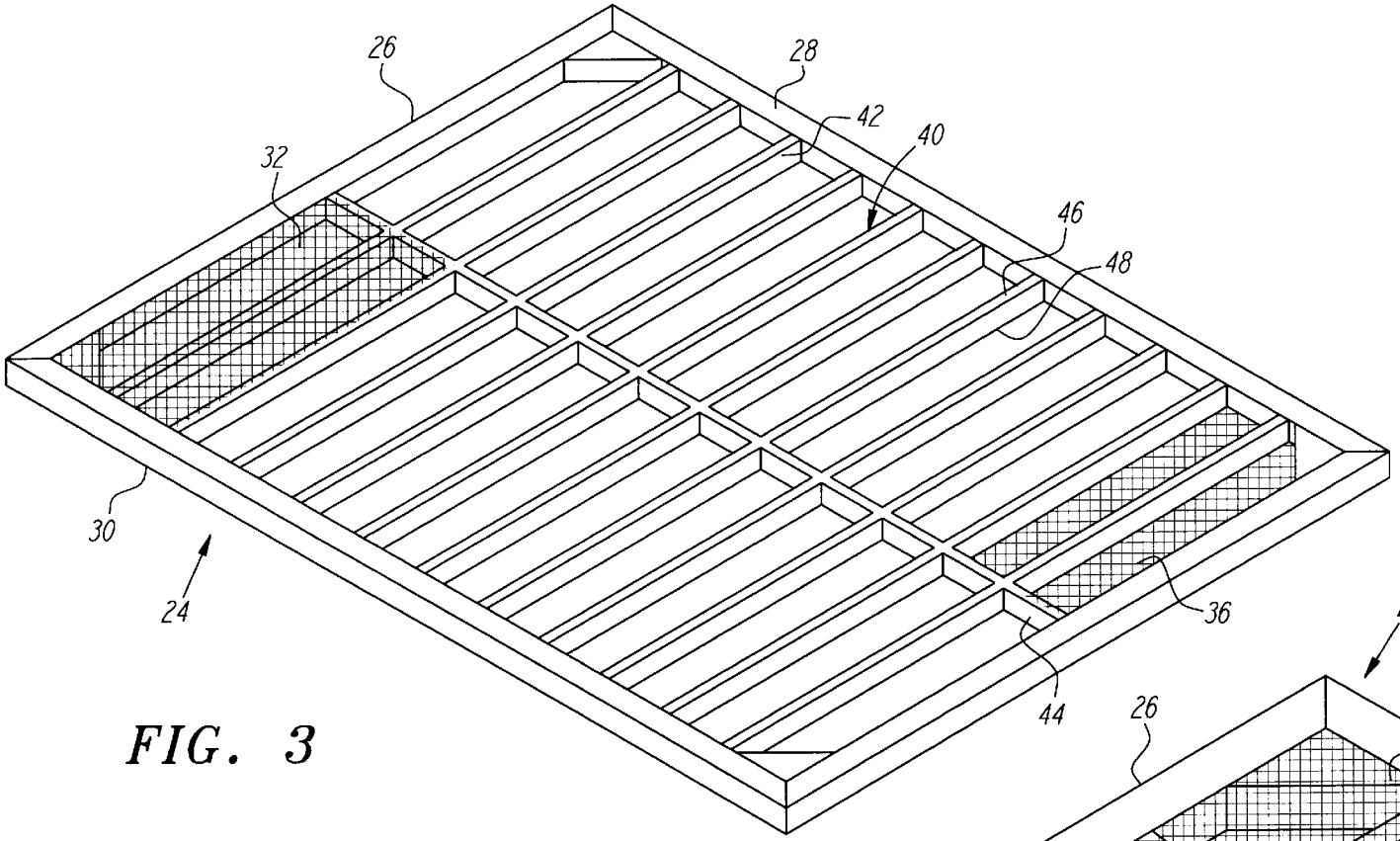
FIG. 3 is a perspective view of a screen assembly.
Figure 4:
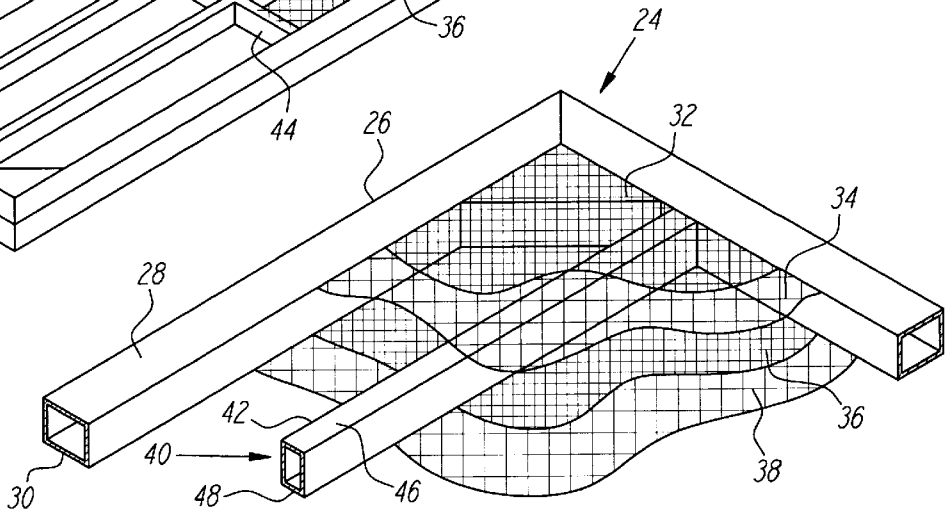
FIG. 4 is a detail perspective view of the screen assembly of FIG. 3.
Figure 5:
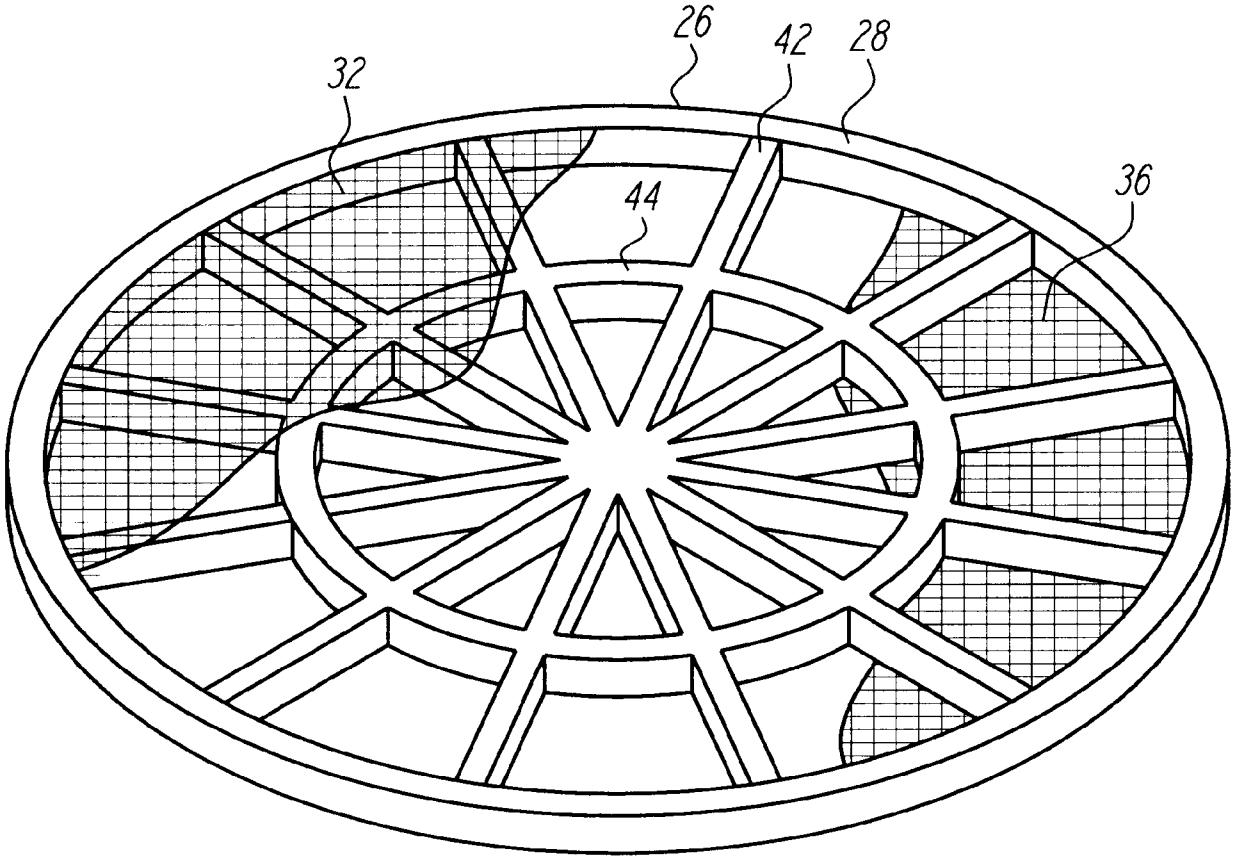
FIG. 5 is a perspective view of a circular screen assembly.

Screen assemblies are illustrated in FIGS. 3, 4 and 5. The screen assembly, generally designated 24, includes a frame 26. The frame may be of any conventional material and typically comes in either rectangular configurations as seen in FIGS. 3 and 4 or circular configurations as seen in FIG. 5. Conventional screen frames are about one inch thick. The screen frame has an upper attachment surface 28 and a lower attachment surface 30.

Screen cloth 32 is fixed relative to the frame 26 at the upper attachment surface 28. Support screen cloth 34 may be positioned between the upper screen cloth 32 and the upper attachment surface 28 of the frame 26. The support screen cloth 34 is also fixed relative to the frame with both the upper screen cloth 32 and the support screen cloth 34 being preferably bonded to the upper attachment surface 28 of the frame 26. Use of a support screen cloth 34 is a conventional practice and presents openings which are substantially larger than the upper screen cloth 32 which is to do the screening. Such a practice is well known in the art. For example, with the upper screen cloth 32 having openings of 45 microns, the support screen cloth 34 may have openings of 300 microns. Substantial latitude is provided in the selection of the relative screen sizes between the upper screen cloth 32 and the support screen cloth 34. The upper screen cloth 32 and the support screen cloth 34 may also be bias mounted on the frame 26 to reduce the possibility of failure along one wire of the screen cloth.

Screen cloth 36 is fixed relative to the frame 26 at the lower attachment surface 30 to provide a safety mesh on the underside of the frame 26. Support screen cloth 38 may also be used with the lower screen cloth 36. The lower screen cloth 36 is positioned between the support screen cloth 38 and the lower attachment surface 30. Again, the openings of the support screen cloth 38 are substantially larger than those of the lower screen cloth 36. The screen cloth 36 and 38 may also be bonded to the frame at a bias to reduce failure opportunities along wire lines. The lower screen cloth 36 has a mesh size providing openings which are larger than the openings provided through the upper screen cloth 32. The openings in the lower screen cloth may be up to five times larger than the openings in the upper screen cloth. Openings which are two times larger have been found useful with fairly uniform materials.

The opening size is a function of the inside dimensions of the screen openings and is best defined by the size of the particles which pass through the screen. The opening size is proportional to the diametrical dimension of a spherical particle that will just pass through the screen. Thus, a bottom screen with openings twice as large as the top screen would just pass spherical particles which have twice the diameter of those which will just pass through the top screen.

The screen assembly may further include a pattern of dividers 40 extending across the frame 26 between the upper screen cloth 32 and the lower screen cloth 36. These dividers 40 conveniently include elements 42 extending in parallel between opposite sides of the frame 26 in a rectangular or square screen frame 26 such as shown in FIGS. 3 and 4. With the screen frame 26 of FIG. 5, the elements 42 may extend radially. Further, the elements may be of any desired shape such as the sinusoidal pattern of cells found in U.S. patent application Ser. No. 08/557,201, now U.S. Pat. No. 5,851,393 to Carr et al. and entitled Screen Assembly, the disclosure of which is incorporated herein by reference.

Any of the elements 42, as contemplated for the embodiments here, have the same height as the thickness of the frame 26 (or at least the same continuity of height so that the screen cloth is not abruptly bent to conform to the frame or elements) and are securely fixed to the frame. One or more elements 44 extending perpendicular to the elements 42 further divide the interior of the frame 26. In the preferred embodiment of FIGS. 3 and 4, eleven straight, parallel elements 42 and one cross element 44 are employed to define twenty four rectangular compartments bounded by these elements and by the upper and lower screens. In the preferred embodiment of FIG. 5, the elements 42 extend radially inwardly from the frame 26 to a common point and the elements 44 are curved such that wedge shaped compartments are formed. Virtually any shape compartment is acceptable. The elements may be welded together, molded or otherwise constructed to provide separation between compartments.

The upper screen cloth 32 and the support screen cloth 34 are preferably bonded to the elements 42 and elements 44 at a first divider attachment surface 46. The lower screen cloth 36 and the support screen cloth 38 are also preferably bonded to a second divider attachment surface 48. The elements 42 are preferably arranged in the direction of flow of materials on the rectangular screens within the housings 12 under the influence of the vibratory drive 16.

In operation, the upper screen cloth 32 supported by the frame 26, the support screen cloth 34, the elements 42 and the elements 44, all of which are bonded together, separates particles able to pass through the openings in the cloth. As the openings of the lower screen cloth 36 are up to five times larger than the openings in the upper screen cloth 32, the particles passing through the compartments to the lower screen cloth 36 continue through that screen to the outlet manifold 20.

The lower screen cloth 36 is designed to provide a safety mesh upon failure of the upper screen cloth 32. The upper screen cloth 32, being finer and subjected to harsher conditions, is more likely to fail before the lower screen cloth 36. Upon failure, oversized particles are able to pass through the upper layer to the lower screen cloth 36. The lower screen cloth 36 will initially pass larger particles based upon the mesh size of the lower screen cloth 36. However, even larger particles presented through the rupture of the upper screen cloth 32 will begin to fill the cavity above the lower screen cloth 36 because they cannot pass through that screen. At some point, a cake is developed which prevents or very substantially reduces the passage of any size particles of the material through the lower screen cloth 36. Where some passage of material continues, the cake is understood to provide the positive effect of inhibiting the larger particles more than the smaller particles regardless of the size of the lower screen. At this point, the compartment defined by the elements 42, the element 44 and the frame 26 within which the failure in the upper screen cloth 32 is located is substantially taken from operation.

Thus, the screen assembly initially passes larger material based on the opening size of the lower screen cloth 36 when the upper screen cloth 32 fails. As the oversized particles begin to accumulate within the compartment, the lower screen cloth 36 beneath that compartment becomes less and less efficient due to blinding. Ultimately, the cake of larger materials which accumulate between the failed upper screen cloth 32 and the lower screen cloth 36 substantially prevents further passage of material. The screen is diminished in efficiency. By having the frame divided into compartments through the use of the elements 42 and the elements 44, the process of blinding takes place faster and the rest of the screen assembly is unaffected. However, the more elements 42 and elements 44 that are used, the more the screening area is reduced.

The minimum size of the openings in the lower screen cloth 36 are determined by requirements in the processing. The closer the opening size of the lower screen cloth 36 to the opening size of the upper screen cloth 32, the greater the likelihood of the lower screen cloth being blinded by the material passing through the upper screen cloth 32 during normal operation. This would be particularly true for elongate particles such as needle-shaped particles. Thus, the larger the ratio of the lower screen openings to the upper screen openings, the less blinding will occur during normal operation. This factor must be offset by the criticality to the final screened product of maintaining the particle size for which the upper screen cloth was selected. During operation with the upper screen in failure, the particles will be limited in size only by the lower screen until the cake is developed. The criticality of the maximum particle size acceptable defines the upper limit of possible screen openings in the lower screen cloth 36.

The smaller the openings in the lower screen cloth 36 relative to the openings in the upper screen cloth 32, the greater the possibility that blinding of the lower screen cloth will become a significant factor. Smaller openings in the upper screen cloth 32 than may otherwise be indicated for normal processing can preserve an acceptable ratio where particle size, even in failure mode, is highly critical. With the lower openings twice as large as the upper openings, many materials appear to process well. Empirical testing provides the best indicator of the opening ratio which will best serve the processing needs in any given situation.

The upper limit to the range of lower screen cloth openings to upper screen cloth openings is influenced by the time required to develop the cake on the lower screen cloth during failure of the upper screen cloth. The larger the ratio, the longer this time will be. If the rupture in the upper screen cloth is not large, this time could be quite long. Beyond a ratio of about 5:1, the effectiveness of the safety feature is substantially diminished because of these considerations.

Accordingly, an improved screen structure is disclosed for limiting the effect of screen failure on a screen separating system. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A screen assembly for a vibratory separator comprising a frame having a first attachment surface on one side and a second attachment surface on the other side;

first screen cloth fixed relative to the frame at the first attachment surface, the first screen cloth having first openings therethrough;

second screen cloth fixed relative to the frame at the second attachment surface, the second screen cloth having second openings larger than and up to five times larger than the first openings of the first screen cloth.

2. The screen assembly for a vibratory separator of claim 1 further comprising first support screen cloth fixed relative to the frame between the first screen cloth and the frame and having third openings substantially larger than the first openings of the first screen cloth.

3. The screen assembly for a vibratory separator of claim 2 further comprising second support screen cloth fixed relative to the frame and having fourth openings substantially larger than the second openings of the second screen cloth, the second screen cloth being between the frame and the second support screen cloth.

4. The screen assembly for a vibratory separator of claim 1 further comprising second support screen cloth fixed relative to the frame and having fourth openings substantially larger than the second openings of the second screen cloth, the second screen cloth being between the frame and the second support screen cloth.

5. The screen assembly for a vibratory separator of claim 1, the first screen cloth and the second screen cloth being bias mounted on the frame.

6. The screen assembly for a vibratory separator of claim 1, the second openings being from two to five times larger than the first openings.

7. A screen assembly for a vibratory separator comprising a frame having a first attachment surface on one side and a second attachment surface on the other side;

first screen cloth fixed relative to the frame at the first attachment surface and having first openings;

second screen cloth fixed relative to the frame at the second attachment surface, the second screen cloth having second openings larger than and up to five times larger than the first openings of the first screen cloth;

a pattern of dividers extending across the frame, the dividers having a first divider attachment surface continuous with the first attachment surface and a second divider attachment surface continuous with the second attachment surface.

8. The screen assembly for a vibratory separator of claim 7 further comprising first support screen cloth fixed relative to the frame between the first screen cloth and the frame and dividers and having third openings substantially larger than the first openings of the first screen cloth.

9. The screen assembly for a vibratory separator of claim 7 further comprising second support screen cloth fixed relative to the frame and having fourth openings substantially larger than the second openings of the second screen cloth, the second screen cloth being between the frame and the second support screen cloth.

10. The screen assembly for a vibratory separator of claim 7, the frame being rectangular, the dividers including straight elements extending mutually parallel across the frame from one side to another and at least one cross element extending perpendicularly to the straight elements.

11. The screen assembly for a vibratory separator of claim 7, the frame being circular, the dividers including straight elements extending radially inwardly from the frame and at least one segment of an element concentric with the frame and inwardly of the frame.

12. The screen assembly for a vibratory separator of claim 7, the second openings being from two to five times larger than the first openings.

13. A screen assembly for a vibratory separator comprising a frame having a first attachment surface on one side and a second attachment surface on the other side;

first screen cloth fixed relative to the frame at the first attachment surface, the first screen cloth having first openings therethrough;

second screen cloth fixed relative to the frame at the second attachment surface, the second screen cloth having second openings larger than and up to five times larger than the first openings of the first screen cloth;

a pattern of dividers extending across the frame, the dividers having a first divider attachment surface continuous with the first attachment surface and a second divider attachment surface continuous with the second attachment surface, the first screen cloth being attached at the first divider attachment surface and the second screen cloth being attached at the second divider attachment surface.

14. The screen assembly for a vibratory separator of claim 13 further comprising first support screen cloth fixed relative to the frame between the first screen cloth and the frame and having third openings substantially larger than the first openings of the first screen cloth.

15. The screen assembly for a vibratory separator of claim 13, the frame being rectangular, the dividers including straight elements extending mutually parallel across the frame from one side to another and at least one cross element extending perpendicularly to the straight elements.

16. The screen assembly for a vibratory separator of claim 15, the straight elements extending between opposed sides of the frame.

17. The screen assembly for a vibratory separator of claim 16, the pattern of dividers creating about twenty four compartments between the first screen and the second screen.

18. The screen assembly for a vibratory separator of claim 13, the frame being circular, the dividers including straight elements extending radially inwardly from the frame and at least one segment of an element concentric with the frame and inwardly of the frame.

19. The screen assembly for a vibratory separator of claim 13, the first screen cloth and the second screen cloth being bias mounted on the frame and relative to the pattern of dividers.

20. The screen assembly for a vibratory separator of claim 13, the second openings being from two to five times larger than the first openings.

21. A vibratory separator comprising a base;

a housing resiliently mounted on the base;

a vibratory drive mounted to the housing;

at least one screen assembly mounted on the housing and including a frame having a first attachment surface on one side and a second attachment surface on the other side, first screen cloth fixed relative to the frame at the first attachment surface, and second screen cloth fixed relative to the frame at the second attachment surface, the second screen cloth having openings larger than and up to five times larger than the openings of the first screen cloth.

22. A vibratory separator comprising a base;

a housing resiliently mounted on the base;

a vibratory drive mounted to the housing;

at least one screen assembly mounted on the housing and including a frame having a first attachment surface on one side and a second attachment surface on the other side, first screen cloth fixed relative to the frame at the first attachment surface, second screen cloth fixed relative to the frame at the second attachment surface, the second screen cloth having openings larger than and up to five times larger than the openings of the first screen cloth, and a pattern of dividers extending across the frame, the dividers having the same height as the thickness of the frame, the dividers having a first divider attachment surface and a second divider attachment surface, the first screen cloth being attached at the first divider attachment surface and the second screen cloth being attached at the second divider attachment surface.

23. The vibratory separator of claim 22, the dividers including straight elements extending mutually parallel across the frame from one side to another and at least one cross element extending perpendicularly to the straight elements.

24. The vibratory separator of claim 23, the frame being rectangular, the straight elements extending between opposed sides of the frame.

25. The vibratory separator of claim 24, the pattern of dividers creating about twenty four compartments between the first screen and the second screen.

26. The vibratory separator of claim 23, the straight elements extending in the direction of material flow on the screen.

27. The vibratory separator of claim 23, the screen assembly further including first support screen cloth fixed relative to the frame between the first screen cloth and the frame and having openings substantially larger than the openings of the first screen cloth vibratory separator.

28. The vibratory separator of claim 22, the second screen cloth having openings two to five times larger than the openings of the first screen cloth.

* * * * *